US009160066B2

(12) United States Patent
Liu et al.

(10) Patent No.: US 9,160,066 B2
(45) Date of Patent: Oct. 13, 2015

(54) UNIPOLAR ANTENNA, WIRELESS ACCESS APPARATUS AND WIRELESS ROUTER

(75) Inventors: Ruopeng Liu, Guangdong (CN); Guanxiong Xu, Guangdong (CN)

(73) Assignees: KUANG-CHI INNOVATIVE TECHNOLOGY LTD., FuTian District, Shenzhen, Guangdong; KUANG-CHI INSTITUTE OF ADVANCED TECHNOLOGY, High-Tech Industrial Estate, Nanshan District, Shenzhen, Guangdong ( * ) Notice: Subject to any disclaimer, the term of this patent is extended or adjusted under 35 U.S.C. 154(b) by 350 days.

(21) Appl. No.: 13/521,744

(22) PCT Filed: Nov. 8, 2011

(86) PCT No.: PCT/CN2011/081901

§ 371 (c)(1),
(2), (4) Date: Jul. 12, 2012

(87) PCT Pub. No.: WO2013/040826

PCT Pub. Date: Mar. 28, 2013

(65) Prior Publication Data

US 2013/0077566 A1 Mar. 28, 2013

(51) Int. Cl.

| | |
|---|---|
| ***H01Q 1/38*** | (2006.01) |
| ***H01Q 1/48*** | (2006.01) |
| ***H01Q 1/22*** | (2006.01) |
| ***H01Q 9/30*** | (2006.01) |
| ***H01Q 5/364*** | (2015.01) |

(52) U.S. Cl.

CPC ..... *H01Q 1/38* (2013.01); *H01Q 1/2291* (2013.01); *H01Q 1/48* (2013.01); *H01Q 5/364* (2015.01); *H01Q 9/30* (2013.01)

(58) Field of Classification Search

CPC ..... H01Q 1/2291; H01Q 1/38; H01Q 1/48; H01Q 9/30; H01Q 5/364

See application file for complete search history.

(56) References Cited

U.S. PATENT DOCUMENTS

| | | | | |
|---|---|---|---|---|
| 6,295,029 | B1 * | 9/2001 | Chen et al. | 343/700 MS |
| 6,842,145 | B1 * | 1/2005 | Ryken et al. | 343/700 MS |
| 7,138,948 | B2 * | 11/2006 | Yeh | 343/700 MS |
| 7,705,788 | B2 * | 4/2010 | Hung et al. | 343/702 |
| 8,451,176 | B2 * | 5/2013 | Biswas et al. | 343/700 MS |
| 2007/0069955 | A1 * | 3/2007 | McCorkle | 343/700 MS |
| 2008/0094284 | A1 * | 4/2008 | Mei | 343/700 MS |
| 2012/0229356 | A1 * | 9/2012 | Sudo et al. | 343/834 |
| 2012/0293385 | A1 * | 11/2012 | Liu et al. | 343/787 |

* cited by examiner

*Primary Examiner* — Trinh Dinh
(74) *Attorney, Agent, or Firm* — Winston Hsu; Scott Margo

(57) ABSTRACT

The present disclosure discloses a unipolar antenna, a wireless access apparatus and a wireless router. The unipolar antenna of the present disclosure comprises a medium substrate, as well as a power feeding point, a feeder line and a metal structure that are disposed on a surface of the medium substrate. The feeder line is connected to the power feeding point, and the feeder line and the metal structure are coupled with each other. The unipolar antenna, the wireless access apparatus and the wireless router of the present disclosure can transmit or receive electromagnetic signals of two or more different wavebands simultaneously so that they can operate within multiple operation wavebands in a single-frequency mode and operate within different operation wavebands simultaneously in a multi-frequency mode. Thereby, the antenna can be miniaturized on the premise of satisfying the performance requirements of the communication devices.

10 Claims, 12 Drawing Sheets

UNIPOLAR ANTENNA, WIRELESS ACCESS APPARATUS AND WIRELESS ROUTER

FIELD OF THE INVENTION

The present disclosure generally relates to the technical field of wireless communication, and more particularly, to a unipolar antenna, a wireless access apparatus and a wireless router.

BACKGROUND OF THE INVENTION

With advancement of the wireless communication technologies, requirements on wireless communication devices become ever higher. For antennas that function to transmit and receive electromagnetic (EM) signals, a number of structures have been developed to satisfy requirements of the communication devices. This imposes greater challenges in terms of performances or structures of the antenna.

An antenna acts as a transmitting unit and a receiving unit for RF signals, and the operation performances thereof have a direct influence on the operation performance of the overall electronic system. However, some important parameters of the antenna such as the size, the bandwidth and the gain are restricted by the basic physical principles (e.g., the gain limit and the bandwidth limit under the limitation of a fixed size). The limits of these parameters make miniaturization of the antenna much more difficult than miniaturization of other components; and furthermore, due to complexity of analysis of the electromagnetic field of the RF component, even approximately reaching these limits represents a great technical challenge.

For a conventional antenna, the radiating operation frequency thereof is positively correlated with the size of the antenna directly, and the bandwidth is positively correlated with the area of the antenna, so the antenna usually has to be designed to have a physical length of a half wavelength. Besides, in some more complex electronic systems, an additional impedance matching network needs to be disposed at the upstream of the in feed antenna. However, the additional impedance matching network adds to the complexity in design of the feeder line of the electronic systems and increases the area of the RF system and, meanwhile, the impedance matching network also leads to a considerable energy loss. This makes it difficult to satisfy the requirement of a low power consumption in the system design. Due to the limitation of functions of the antenna themselves, most of the current antenna are applied externally to apparatuses and consume much space. Therefore, the functions and sizes of the antenna have become a technical bottleneck that hinders further reduction in volume of the apparatuses that adopt the antenna. Accordingly, how to provide a miniaturized and high-performance antenna for modern electronic integrated systems has become an important technical problem to be tackled.

Additionally, the demands for built-in antennas in various wireless communication devices become increasingly higher. For example, various electronic apparatuses such as wireless access apparatuses and wireless routers substantially all adopt external antennas, which greatly limits the room for industrial design and mechanism design of the products. Moreover, the external antennas necessitate design of a corresponding impedance matching connector and a corresponding mechanism module, which almost account for 90% or more of the cost of the whole antenna. In turn, the increased cost of the whole antenna further drives the cost of the electronic apparatus (e.g., a wireless access apparatus or a wireless router) to increase correspondingly. In contrast, using a built-in antenna will greatly save the cost of the connector and the mechanism module.

SUMMARY OF THE INVENTION

A primary objective of the present disclosure is to provide a unipolar antenna, a wireless access apparatus and a wireless router. By using the metamaterial technologies to design the antenna structure, the unipolar antenna, the wireless access apparatus and the wireless router of the present disclosure allow for miniaturization of the antenna on the premise of satisfying the performance requirements of communication devices. Thereby, the antenna can be either built into a communication device or disposed externally as desired.

To achieve the aforesaid objective, the present disclosure provides a unipolar antenna, which comprises a medium substrate, as well as a power feeding point, a feeder line and a metal structure that are disposed on a surface of the medium substrate. The feeder line is connected to the power feeding point. The feeder line and the metal structure are coupled with each other.

Preferably, the metal structure is formed of a metal sheet that is enchased with a groove topology thereon.

Preferably, a groove width in the groove topology is equal to a pitch between adjacent grooves in the groove topology.

Preferably, the groove width in the groove topology is 0.15 mm.

Preferably, the unipolar antenna further comprises grounding units each having a plurality of metallized vias formed therein.

Preferably, the grounding units are distributed symmetrically at two sides of the power feeding point.

Preferably, the medium substrate is made of one of a ceramic material, a polymer material, a ferroelectric material, a ferrite material and a ferromagnetic material.

Preferably, the unipolar antenna resonates to at least one waveband.

Preferably, frequency ranges of the at least one waveband at least include 2.4 GHz to 2.49 GHz and 5.72 GHz to 5.85 GHz.

Preferably, a non-metallic anti-oxidation film is formed on a surface of the unipolar antenna.

To achieve the aforesaid objective, the present disclosure further provides a wireless access apparatus, which comprises a central processing unit (CPU), a data storage unit and a radio frequency (RF) unit. The data storage unit and the RF unit are connected with the CPU. The RF unit comprises an antenna. The antenna comprises a medium substrate, as well as a power feeding point, a feeder line and a metal structure that are disposed on a surface of the medium substrate. The feeder line is connected to the power feeding point. The feeder line and the metal structure are coupled with each other.

Preferably, the metal structure is formed of a metal sheet that is enchased with a groove topology thereon.

Preferably, a groove width in the groove topology is equal to a pitch between adjacent grooves in the groove topology.

Preferably, the antenna further comprises grounding units each having a plurality of metallized vias formed therein.

Preferably, the grounding units are distributed symmetrically at two sides of the power feeding point.

To achieve the aforesaid objective, the present disclosure further provides a wireless router, which comprises a data processing module, a data storage module, an Ethernet interface, a wireless communication module and an antenna that communicates data with the wireless communication module. The data storage module, the Ethernet interface and the wireless communication module are connected to the data processing module. The antenna comprises a medium substrate, as well as a power feeding point, a feeder line and a metal structure that are disposed on a surface of the medium substrate. The feeder line is connected to the power feeding point. The feeder line and the metal structure are coupled with each other.

Preferably, the metal structure is formed of a metal sheet that is enchased with a groove topology thereon.

Preferably, a groove width in the groove topology is equal to a pita between adjacent grooves in the groove topology.

Preferably, the antenna further comprises grounding units each having a plurality of metallized vias formed therein.

Preferably, the grounding units are distributed symmetrically at two sides of the power feeding point.

The present disclosure has the following benefits: as compared to the prior art, the unipolar antenna, the wireless access apparatus and the wireless router of the present disclosure can transmit or receive electromagnetic signals of two or more different wavebands simultaneously so that they can operate within multiple operation wavebands in a single-frequency mode and operate within different operation wavebands simultaneously in a multi-frequency mode. Thereby, the antenna can be miniaturized on the premise of satisfying the performance requirements of the communication devices.

DETAILED DESCRIPTION OF THE INVENTION

Hereinbelow, the unipolar antenna, the wireless access apparatus and the wireless router of the present disclosure will be further described with reference to the attached drawings and embodiments thereof.

The so-called unipolar antenna is an antenna with only one arm when being viewed from an input end. The unipolar antenna of the present disclosure is designed on the basis of the man-made electromagnetic material technologies. The man-made electromagnetic material refers to an equivalent special material produced by enchasing a metal sheet into a topology metal structure of a particular form and disposing the topology metal structure of the particular form on a substrate having a certain dielectric constant and a certain magnetic permeability. Performance parameters of the man-made electromagnetic material are mainly determined by the subwavelength topology metal structure of the particular form. In the resonance waveband, the man-made electromagnetic material usually exhibits a highly dispersive characteristic; i.e., the impedance, the capacitance and the inductance, the equivalent dielectric constant and the equivalent magnetic permeability of the antenna vary greatly with the frequency. Therefore, the basic characteristics of the antenna can be altered according to the man-made electromagnetic material technologies so that the metal structure and the medium substrate attached thereto equivalently form a special electromagnetic material that is highly dispersive, thus achieving a novel antenna with rich radiation characteristics.

Figure 1A:
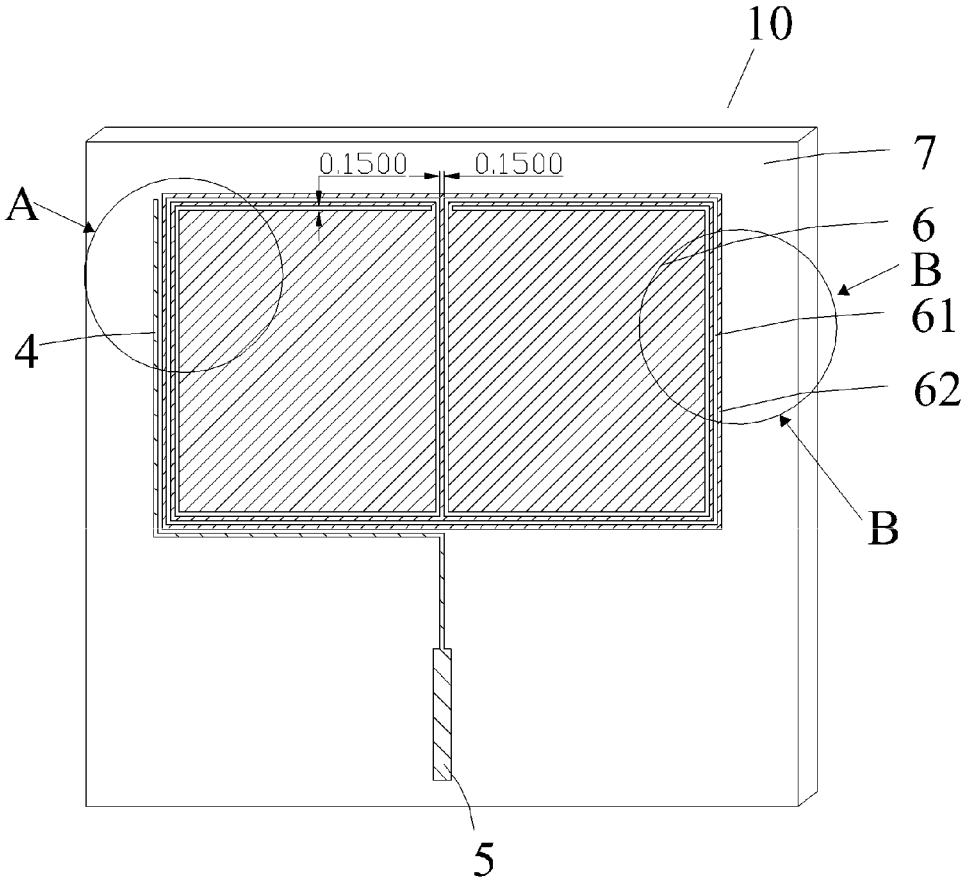
FIG. 1*a* is a schematic structural view of a unipolar antenna according to a first preferred embodiment of the present disclosure.
Figure 1B:
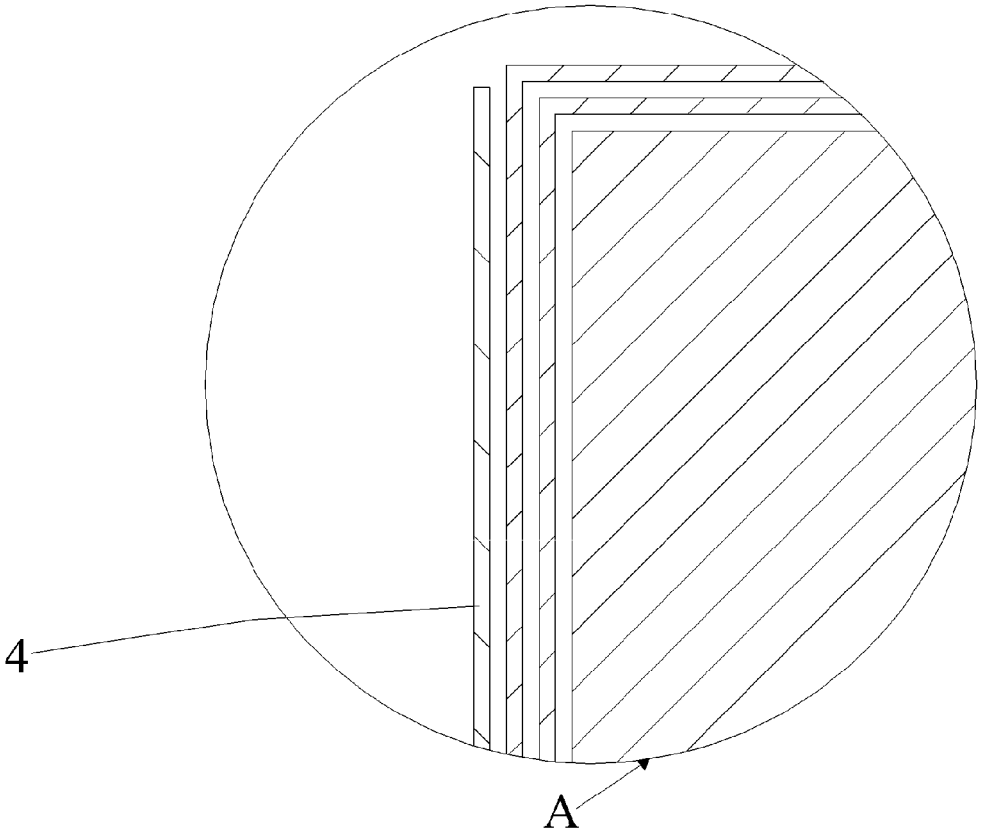
FIG. 1*b* is an enlarged view of a region A of FIG. 1*a*.
Figure 1C:
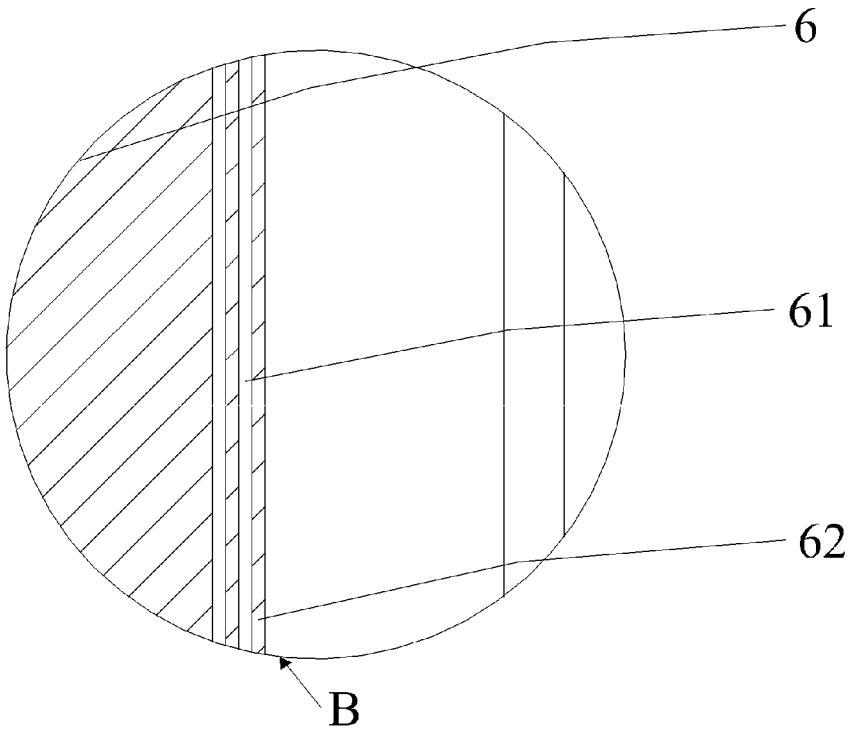
FIG. 1*c* is an enlarged view of a region B of FIG. 1*a;*

Refer to FIG. 1*a*, 1*b* and 1*c*, there is shown in which FIG. 1*a* is a schematic structural view of a unipolar antenna according to a first preferred embodiment of the present disclosure; FIG. 1*b* is an enlarged view of a region A of FIG. 1*a*; and FIG. 1*c* is an enlarged view of a region B of FIG. 1*a*. The unipolar antenna 10 in this embodiment comprises a medium substrate 7, as well as a power feeding point 5, a feeder line 4 and a metal structure 6 of a flat plate form that are disposed on the medium substrate 7. The feeder line 4 is connected to the power feeding point 5. The feeder line 4 and the metal structure 6 are coupled with each other. The metal structure 6 is formed of a metal sheet that is enchased with a groove topology 61 thereon. After the material corresponding to the groove topology 61 is removed through enchasing, the remaining metal sheet is just the metal structure 6. After the groove topology 61 is formed through enchasing, the metal sheet presents a metal wiring 62 comprised within the metal structure 6. A pitch between adjacent grooves in the groove topology 61 is just a width of the metal wiring 62, and a groove width of the groove topology 61 is equal to the width of the metal wiring 62 and is 0.15 mm. The medium substrate 7 may be made of one of a ceramic material, a polymer material, a ferroelectric material, a ferrite material and a ferromagnetic material, and is preferably made of a polymer material such as an FR-4 material or an F4B material.

In this embodiment, the metal structure 6 is in the form of an axially symmetrical flat plate. The metal structure 6 is made of copper or silver. Preferably, the metal structure 6 is made of copper because copper is inexpensive and has a good electrical conductivity. In order to achieve a better impedance match, the metal structure 6 may also be made of a combination of copper and silver.

Figure 2:
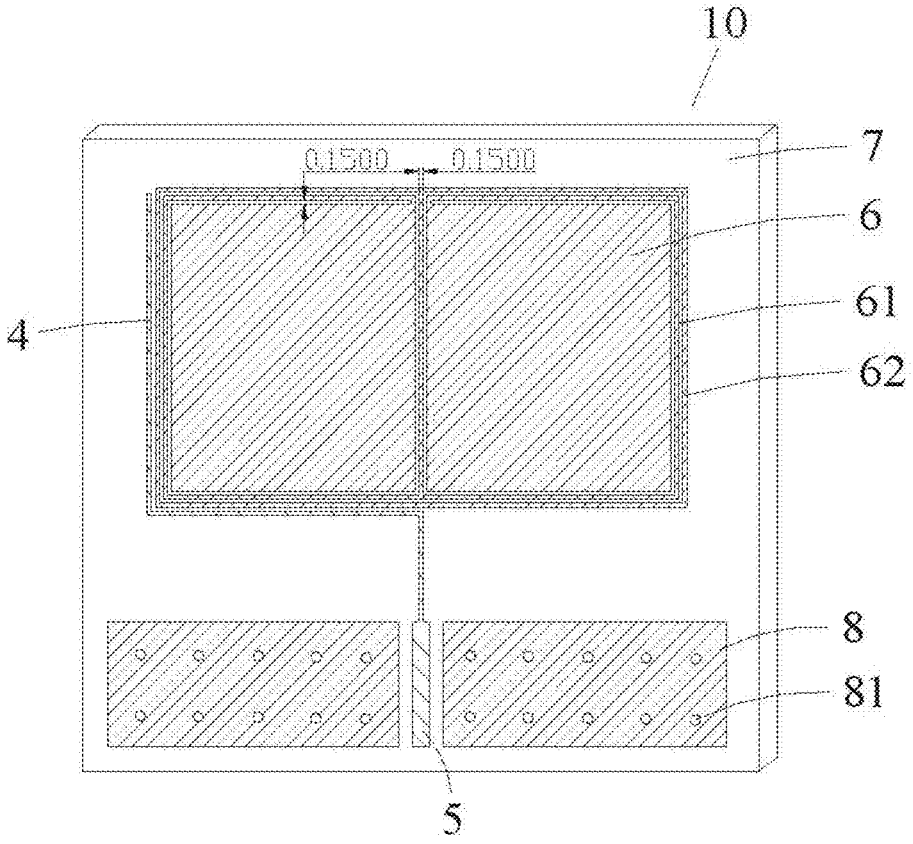
FIG. 2 is a schematic structural view of a unipolar antenna according to a second preferred embodiment of the present disclosure.
Figure 3:
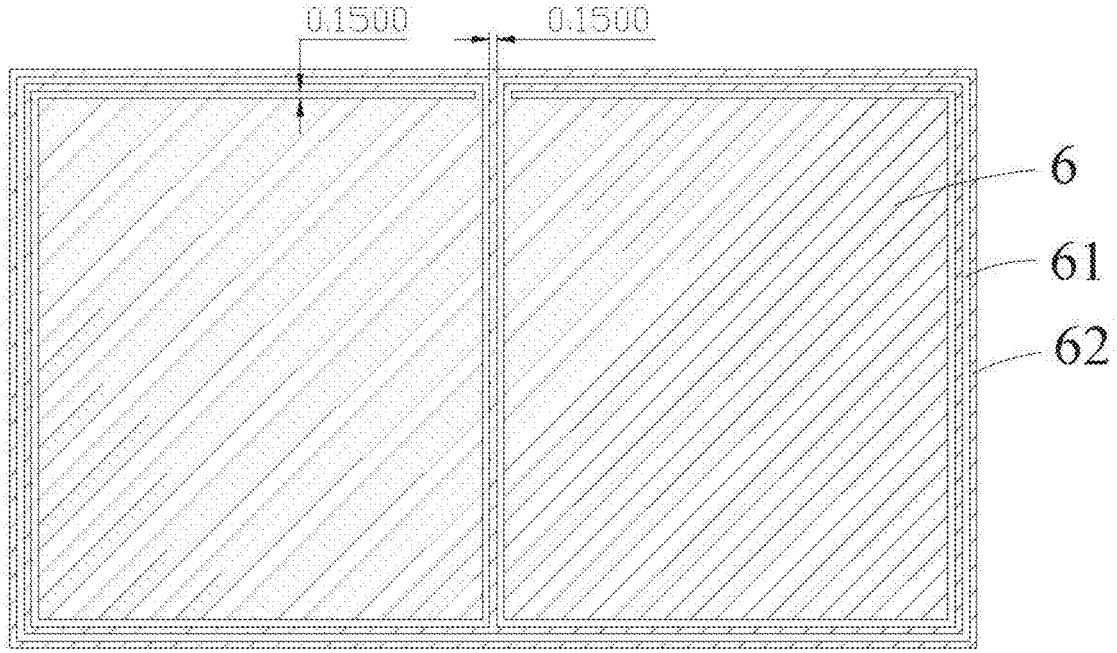
FIG. 3 is a schematic enlarged view of a metal structure in the unipolar antenna according to the second preferred embodiment of the present disclosure.

Referring to FIG. 2 and FIG. 3, a schematic structural view of a unipolar antenna according to a second preferred embodiment of the present disclosure and a schematic enlarged view of a metal structure in this embodiment are shown therein. Identical to what described in the first preferred embodiment, the unipolar antenna 10 in the second preferred embodiment comprises a medium substrate 7, as well as a power feeding point 5, a feeder line 4 connected to the power feeding point 5, and a metal structure 6 of a flat plate form that are disposed on the medium substrate 7. However, the second preferred embodiment differs from the first preferred embodiment in that, the unipolar antenna 10 in the second preferred embodiment further comprises grounding units 8 each having a plurality of metallized vias 81 formed therein. The grounding units 8 are distributed symmetrically at two sides of the power feeding point 5. The medium substrate 7 is the same as that of the first preferred embodiment.

The signal communication between the feeder line 4 and the metal structure 6 may be achieved in many ways. The feeder line 4 may be directly connected with the metal structure 6; and the connection point between the feeder line 4 and the metal structure 6 may be located at any position on the metal structure 6. Alternatively, the feeder line 14 is disposed to encircle a periphery of the metal structure 6, and an end of the feeder line 4 is disposed at any position on the periphery of the metal structure 6.

By virtue of the characteristics of the man-made electromagnetic material and by having a metal structure enchased on the metal sheet in this embodiment, the metal structure and the medium substrate attached thereto jointly form an electromagnetic material whose equivalent dielectric constant varies according to the Lorentz material resonance model, thereby achieving an antenna that can resonate to multiple wavebands. In this embodiment, the unipolar antenna as shown in FIG. 2 resonates to two wavebands of 2.4 GHz to 2.49 GHz and 5.72 GHz to 5.85 GHz; and both the length and the width of the metal structure 6 can be adjusted arbitrarily according to the layout of a communication device so long as the form of the metal structure 6 is consistent with that of this embodiment. The unipolar antenna can be used in both a communication device operating in a single waveband of 2.4 GHz to 2.49 GHz or 5.72 GHz to 5.85 GHz and a communication device operating in two wavebands of 2.4 GHz to 2.49 GHz and 5.72 GHz to 5.85 GHz.

Figure 4:
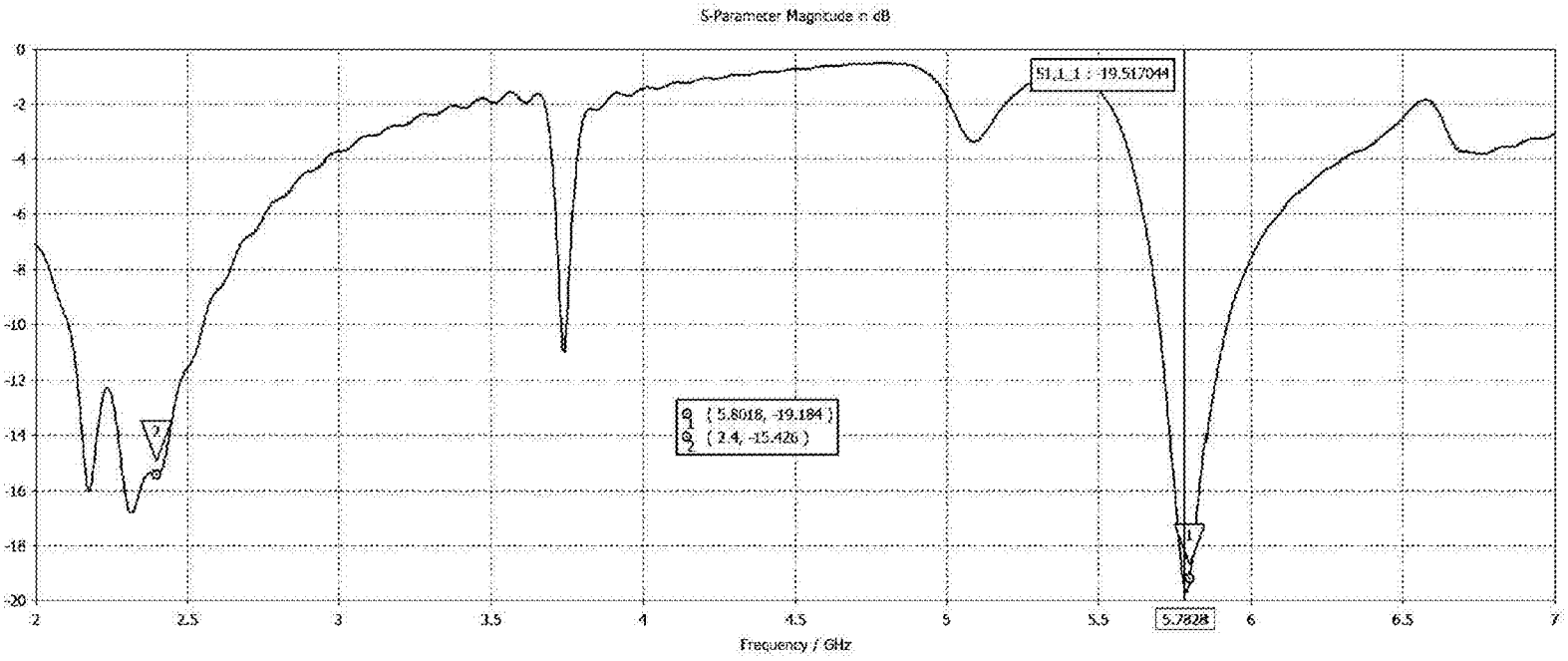
FIG. 4 is a simulation diagram of parameters S of the unipolar antenna according to the second preferred embodiment of the present disclosure.
Figure 5:
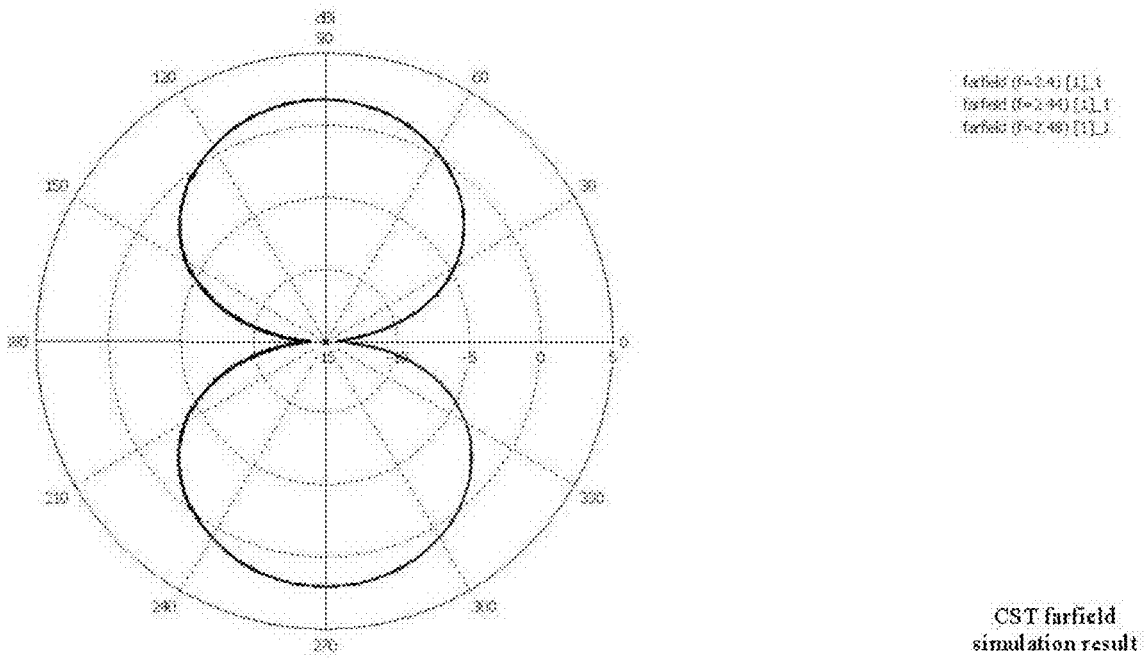
FIG. 5 is a diagram illustrating a farfield simulation result in a direction E of the unipolar antenna according to the second preferred embodiment of the present disclosure when respectively operating at 2.4 GHz, 2.44 Hz and 2.48 GHz.
Figure 6:
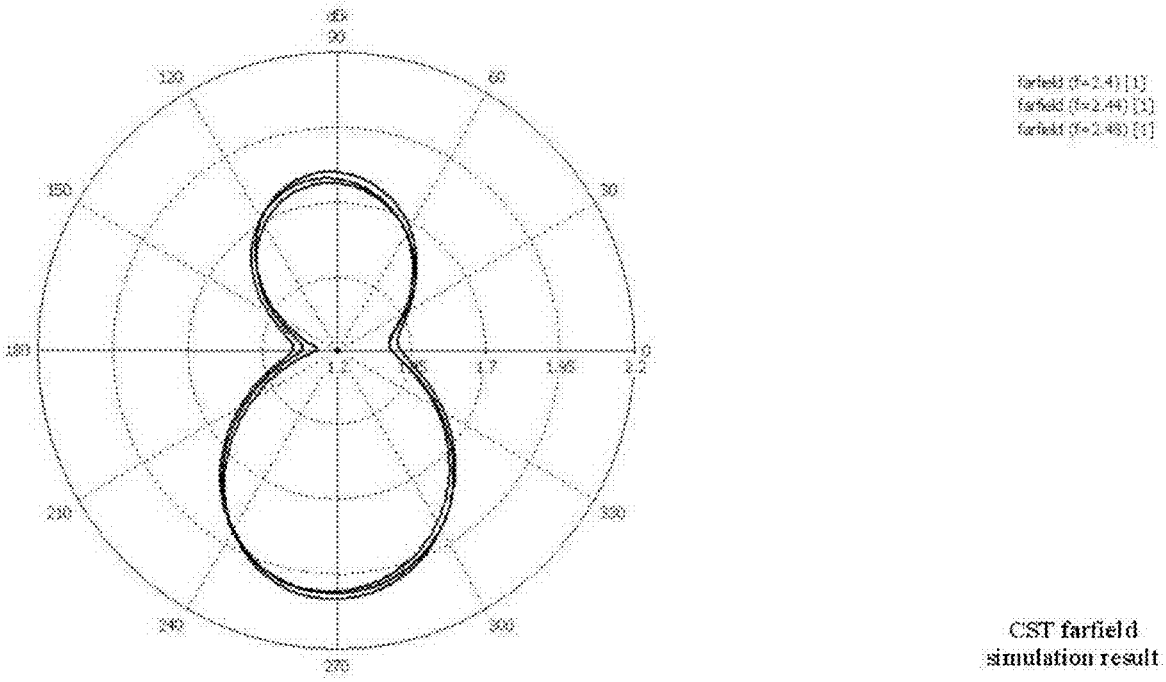
FIG. 6 is a diagram illustrating a farfield simulation result in a direction H of the unipolar antenna according to the second preferred embodiment of the present disclosure when respectively operating at 2.4 GHz, 2.44 GHz and 2.48 GHz.
Figure 7:
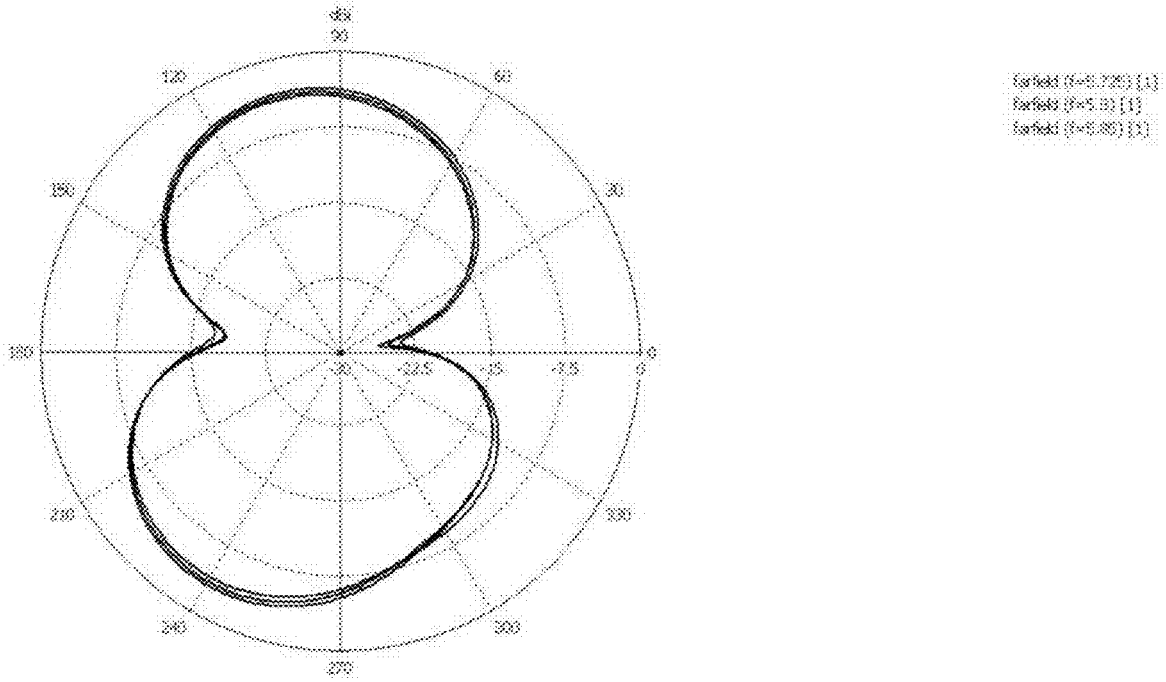
FIG. 7 is a diagram illustrating a farfield simulation result in the direction E of the unipolar antenna according to the second preferred embodiment of the present disclosure when respectively operating at 5.725 GHz, 5.8 GHz and 5.85 GHz.
Figure 8:
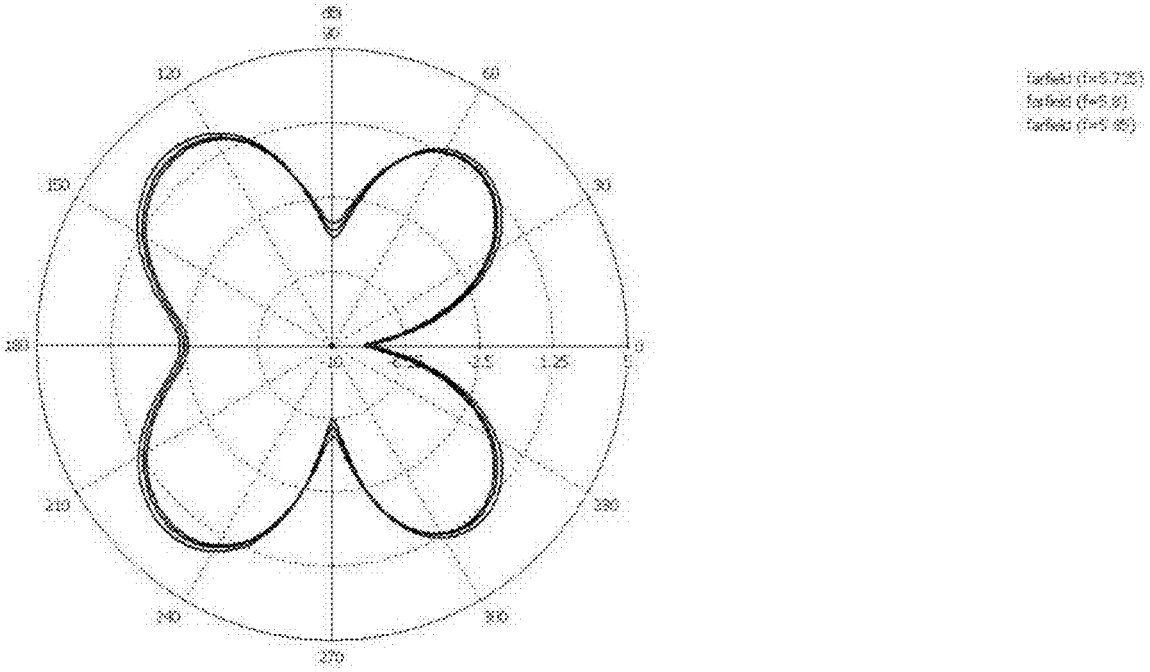
FIG. 8 is a diagram illustrating a farfield simulation result in the direction H of the unipolar antenna according to the second preferred embodiment of the present disclosure when respectively operating at 5.725 GHz, 5.8 GHz and 5.85 GHz.

Referring to FIG. 4, there is shown a simulation diagram of a parameter S of the unipolar antenna according to the second preferred embodiment of the present disclosure. This diagram shows that the unipolar antenna 10 of the second preferred embodiment has a loss of −15.426 dB and a loss of −19.184 dB at 2.4 GHz and 5.8018 GHz respectively, and losses within the wavebands of 2.4 GHz to 2.49 GHz and 5.72 GHz to 5.85 GHz of the present disclosure are all less than −10 dB. This indicates that the unipolar antenna of the present disclosure can operate within the waveband of 2.4 GHz to 2.49 GHz or 5.72 GHz to 5.85 GHz independently and can also operate within the wavebands of 2.4 GHz to 2.49 GHz and 5.72 GHz to 5.85 GHz simultaneously, and satisfies the requirement of the wireless communication device on the antenna.

FIG. 5, FIG. 6, FIG. 7 and FIG. 8 are diagrams illustrating farfield simulation results in a vertical plane (i.e. E-Plane) direction and a horizontal plane (i.e. H-Plane) direction of the unipolar antenna according to the second preferred embodiment of the present disclosure when operating at 2.4 GHz, 2.44 GHz and 2.48 GHz and at 5.725 GHz, 5.8 GHz and 5.85 GHz, respectively. As can be observed from these results, the polarization effect of the unipolar antenna of the present disclosure is not inferior to the conventional antenna and satisfies the application standards.

In the present disclosure, the unipolar antenna 10 may be manufactured in various ways so long as the design principle of the present disclosure is followed. The most common method is to adopt manufacturing methods of various printed circuit boards (PCBs) (e.g., the manufacturing method of a PCB covered by copper), which can all satisfy the processing requirement of the present disclosure. Apart from this, other processing means may also be used depending on actual requirements, for example, the conductive silver paste and ink processing, the flexible PCB processing for various deformable components, the ferrite sheet antenna processing, and the processing means of the ferrite sheet in combination with the PCB. The processing means of the ferrite sheet in combination with the PCB means that the groove topology is processed by an accurate processing process for the PCB and other auxiliary portions are processed by using ferrite sheets. Because the metal structure 6 is formed of the inexpensive copper material, the metal structure 6 is liable to oxidation when being exposed to the air and this will cause the frequencies to which the unipolar antenna 10 resonates to shift or cause the performance of the unipolar antenna 10 to be degraded remarkably. Because of this, a non-metallic anti-oxidation film is disposed on a surface of the unipolar antenna. Because the primary characteristics of the present disclosure are all associated with the design of the groove topology 61 of the metal structure 6, the lead of the feeder line 4 has a relatively small influence on the radiation frequency of the unipolar antenna 10. On the basis of this feature, the unipolar antenna may be flexibly arranged at any position in a system, and this can reduce the complexity in installation and testing.

The unipolar antenna 10 can be directly applied to a wireless communication device (particularly, an access point (PA) or a wireless router) comprising the frequencies of 2.4 GHz and 5.8 GHz. The unipolar antenna 10 may be directly disposed on a PCB of the wireless communication device so that the unipolar antenna 10 is built in the device to which the antenna is applied; or the unipolar antenna 10 may also be connected with the PCB of the wireless communication device through an interface so that the unipolar antenna 10 is externally built with respect to the device to which the antenna is applied.

Figure 9:
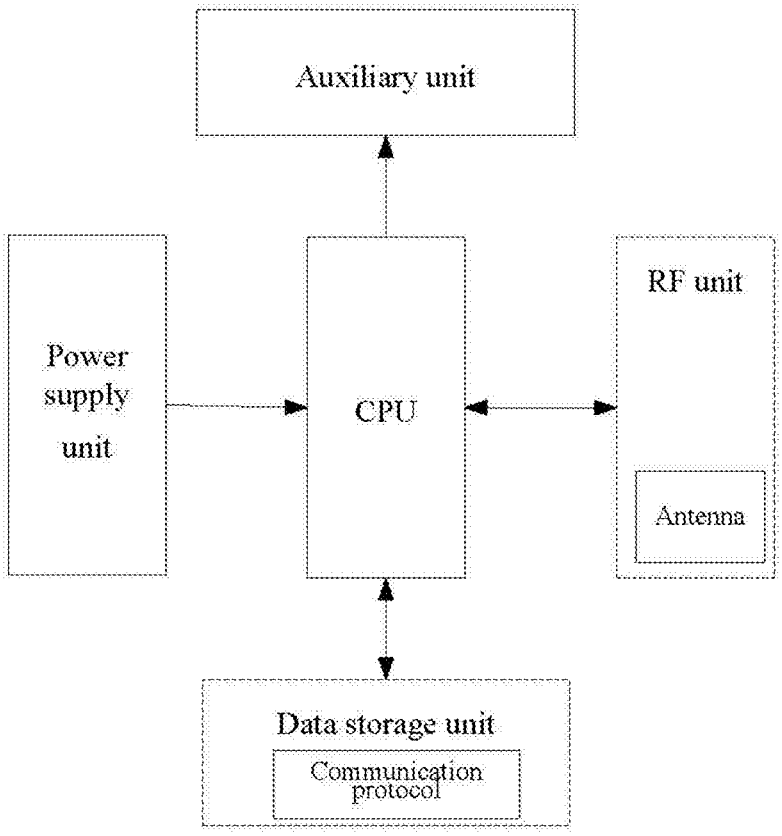
FIG. 9 is a schematic structural view of a wireless access apparatus according to a third preferred embodiment of the present disclosure.

FIG. 9 is a schematic structural view of a wireless access apparatus according to a third preferred embodiment of the present disclosure. As shown in FIG. 9, the wireless access apparatus comprises a central processing unit (CPU), a data storage unit, a radio frequency (RF) unit, a power supply unit and an auxiliary unit.

The power supply unit supplies electric power necessary for operation of the CPU. The CPU may be a microprocessor, an SOC, or an RISC microprocessor chip. The data storage unit has communication protocols (e.g., WIFI and WLAN) stored therein, and may be further divided into a read only memory (ROM) and a random access memory (RAM). The RF unit comprises the antenna of the present disclosure. For the technical features of the antenna, reference may be made to the first preferred embodiment and the second preferred embodiment of the present disclosure, and no further description will be made herein. The auxiliary unit may be one or more of a human-machine interface (HMI), a display, a power supply indicator and a status indicator.

The CPU is connected with the RF unit and the data storage unit. The CPU exchanges data with external devices through the antenna in the RF unit and processes the data. The CPU can invoke the communication protocols from the data storage unit, and stores or buffers the data to the data storage unit. The auxiliary unit can impart some auxiliary functions to an onboard wireless access apparatus, and may be for example an indicator for displaying a connection status or a power supply indicator for displaying power supply conditions.

Figure 10:
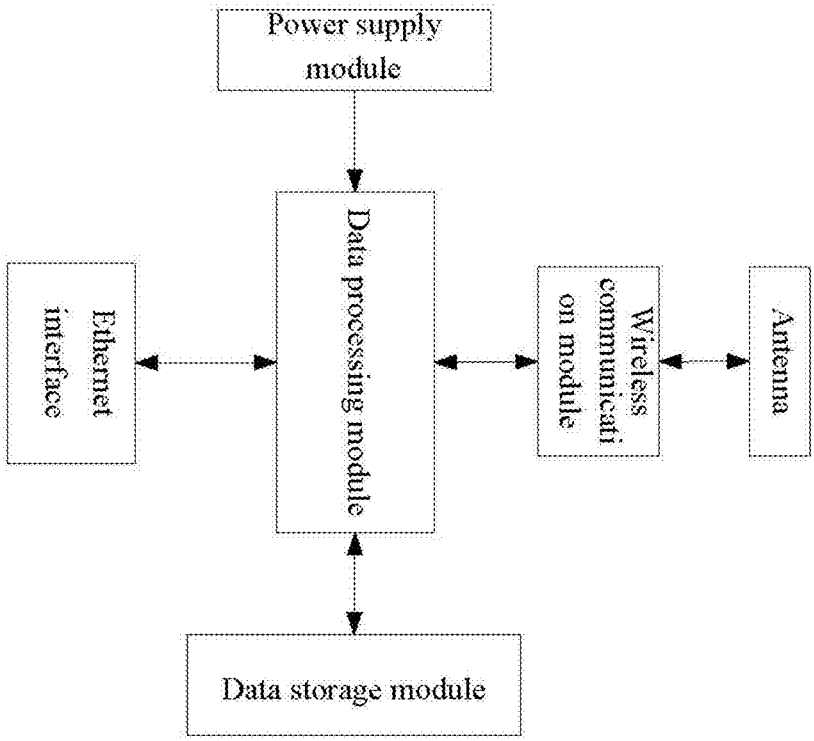
FIG. 10 is a schematic structural view of a wireless router according to a fourth preferred embodiment of the present disclosure.

FIG. 10 is a schematic structural view of a wireless router according to a fourth preferred embodiment of the present disclosure. As shown in FIG. 10, the wireless router comprises a data processing module, a data storage module, an Ethernet interface, a wireless communication module, a power supply module and an antenna.

The data processing module is connected to the data storage module, the Ethernet interface and the wireless communication module. The antenna is connected with and communicates data with the wireless communication module. For the technical features of the antenna, reference may be made to the first preferred embodiment and the second preferred embodiment of the present disclosure, and no further description will be made herein. The power supply module supplies electric power necessary for operation of the data processing module. An ARM processor may be used as the data processing module. The data storage module has communication protocols (e.g., WIFI, WLAN and IEEE802.11b/g/n) stored therein, and comprises an ROM, an RAM and an erasable memory. The wireless router may further comprise some auxiliary modules (not shown) such as a power supply indicator or a status indicator.

According to the above descriptions, the unipolar antenna, the wireless access apparatus and the wireless router of the present disclosure allow for resonance within one waveband or within two or more different wavebands so as to transmit or receive electromagnetic signals of one waveband separately or to transmit or receive electromagnetic signals of two or more different wavebands simultaneously. By means of only one antenna of the present disclosure, the requirements for operation within multiple operation wavebands in a single-frequency mode and operation within different operation wavebands simultaneously in a multi-frequency mode can be satisfied. Moreover, because the physical dimension of the metal structure of the antenna of the present disclosure is not limited by the half-wavelength physical length, the corresponding antenna can be designed according to dimensions of the wireless communication device, thus satisfying the requirements for a miniaturized and built-in antenna design of the wireless access apparatus and the wireless router.

What described above are only some of the embodiments of the present disclosure, but are not intended to limit the scope of the present disclosure. Any equivalent structures or equivalent process flow modifications that are made according to the specification and the attached drawings of the present disclosure, or any direct or indirect applications of the present disclosure in other related technical fields shall all be covered within the scope of the present disclosure.

What is claimed is:

1. A unipolar antenna, comprising a medium substrate, as well as a power feeding point, a feeder line and a metal structure that are disposed on a surface of the medium substrate, wherein the feeder line is connected to the power feeding point, the feeder line and the metal structure are coupled with each other; the unipolar antenna further comprises grounding units each having a plurality of metallized vias formed in each of the grounding units;

wherein the feeder line comprises a first line, a second line and a third line which are connected end to end, the first line is adjacent to and parallel to a side of the metal structure, the second line is adjacent to and parallel to a half of a bottom of the metal structure, and the third line is connected between an end of the second line and the power feeder line.

2. The unipolar antenna of claim 1, wherein the metal structure is formed of a metal sheet that is enchased with a groove topology on the metal sheet, and the groove topology is consisted of a plurality of grooves.

3. The unipolar antenna of claim 2, wherein a groove width in the groove topology is equal to a pitch between adjacent grooves in the groove topology.

4. The unipolar antenna of claim 3, wherein the groove width in the groove topology is 0.15 mm.

5. The unipolar antenna of claim 1, wherein the grounding units are distributed symmetrically at two sides of the power feeding point.

6. The unipolar antenna of claim 1, wherein the medium substrate is made of one of a ceramic material, a polymer material, a ferroelectric material, a ferrite material and a ferromagnetic material.

7. The unipolar antenna of claim 1, wherein the unipolar antenna resonates to at least one waveband.

8. The unipolar antenna of claim 7, wherein frequency ranges of the at least one waveband at least include 2.4 GHz to 2.49 GHz and 5.72 GHz to 5.85 GHz.

9. The unipolar antenna of claim 1, wherein the whole of the metal structure is arranged at a side of the first line of the feeder line, and the metal structure is axially symmetrical with respect to a center line of the power feeder point.

10. The unipolar antenna of claim 1, wherein the metal structure is a closed structure, and the metal structure comprises a first portion adjacent to the feeder line and a second portion far away from the feeder line, and the first portion and the second portion of the metal structure are axially symmetrical with respect to the center line of the power feeder line.

* * * * *